US005088898A

United States Patent [19]

Fukumoto et al.

[11] Patent Number: 5,088,898

[45] Date of Patent: Feb. 18, 1992

[54] RECIPROCATING PUMP

[75] Inventors: Toshiyuki Fukumoto, Osaka; Ryo Imanishi, Hyogo, both of Japan

[73] Assignee: Nippon Pillar Packing Co., Ltd., Osaka, Japan

[21] Appl. No.: 596,718

[22] Filed: Oct. 10, 1990

[30] Foreign Application Priority Data

Dec. 5, 1989 [JP] Japan ..... 1-317206

[51] Int. Cl.[5] ..... F04B 35/02

[52] U.S. Cl. ..... 417/347; 417/343; 417/62

[58] Field of Search ..... 417/62, 343, 347, 344, 417/345, 346

[56] References Cited

U.S. PATENT DOCUMENTS 2,463,552 3/1949 Newhall ..... 417/346
4,269,569 5/1981 Hoover ..... 417/347
4,836,756 6/1989 Fukumoto ..... 417/473
4,981,418 1/1991 Kingsford et al. ..... 417/63

*Primary Examiner*—Richard A. Bertsch
*Assistant Examiner*—Charles Freay
*Attorney, Agent, or Firm*—Griffin, Branigan & Butler

[57] ABSTRACT

A reciprocating pump comprises a plurality of pump sections, each pump section having a suction inlet and a discharge outlet, the inlets all connecting with a common passageway through which the pumped fluid is supplied and the outlets all connecting with a common discharge passageway through which the pumped fluid is discharged. Each pump section includes a bellows which reciprocates to alternately produce suction and discharge strokes, with a change-over period between strokes. A drive control for the bellows delays the start of strokes by the bellows so that when one pump section is in a suction stroke or a change-over period, at least one other pump section is in a discharge stroke. The arrangement reduces variations in pressure in the discharge from the pump.

2 Claims, 5 Drawing Sheets

RECIPROCATING PUMP

FIELD OF THE INVENTION

The invention relates to reciprocating pumps having a plurality of pump sections, each pump section having a reciprocating action element, such as a bellows or diaphragm. More particularly, the present invention relates to control of the action elements in pumps having plural pump sections, the control being such that at least one pump section is discharging into a common pump discharge passageway at all times.

BACKGROUND OF THE INVENTION

Bellows or diaphragm pumps having a single pump section are well known in the art. In these devices the discharge and suction strokes are alternately produced by the reciprocating motion of the pump action element, i.e. the diaphragm or bellows. As a result, pulses of fluid are discharged from the pump and the pressure of the fluid being discharged from such pumps varies greatly. Such variations are undesirable in that they can cause pipe connections on the discharge side of the pump to be loosened, or cause "knocking" of the pipes thereby creating undesired noise In addition the variations in pressure can cause impurities which may accumulate on the interior wall of the discharge pipe to be peeled therefrom. Finally, if there is a filter in the discharge pipe, the pressure variations can cause enlargement of the filter openings thus lowering the capture rating of the filter.

Also known in the art are bellows or diaphragm pumps having a pair of pump sections with the pump action elements of the two sections being interlocked so that a discharge stroke of one pump section coincides with a suction stroke of the other pump section. Such pumps may have a common discharge passageway and a common suction passageway for the two pump sections. It would at first appear that since one pump section executes a discharge stroke while the other executes a suction stroke, or vice versa, there would be a continuous discharge hence fairly constant pressure should be present in the discharge passageway. However, this is not true in actual practice since it takes the action elements a finite time to stop and change direction. During this change-over interval, which occurs at the same time for both pump section, the pressure in the discharge passageway drops drastically. As a result, there are large pressure variations in the discharge passageway with the same undesirable consequences mentioned above.

To solve the problem of pressure pulsations in the discharge, it has been conventional to provide a pressure regulator or accumulator on the discharge side of the pump. While this reduces the pressure variations, it adds cost to the pumping equipment and complicates construction.

SUMMARY OF THE INVENTION

An object of the present invention is to provide a novel method and apparatus for controlling a reciprocating pump having a plurality of pump sections with a common discharge passageway whereby a substantially continuous discharge of fluid is provided at the discharge side of the pump.

An object of the present invention is to provide a novel method and apparatus for controlling a reciprocating pump having a plurality of pump sections with a common discharge so that pressure variations at the discharge side of the pump are substantially reduced.

An object of the present invention is to provide an improvement in reciprocating pumps of the type having a plurality of pump sections, each of the pump sections including a reciprocating action element movable in first and second directions to define suction and discharge strokes of the pump section, each stroke being separated from a following stroke by a change-over interval, each pump section having a discharge outlet connected to a common discharge passageway for the pump and a suction inlet connected to a common supply passageway for the pump, the improvement comprising a drive control for driving the action elements so that when at least one of the pump sections is in a suction stroke or a change-over interval at least one other of the pump sections is in a discharge stroke. In a preferred embodiment, the pump sections are interconnected in pairs to form composite pump sections wherein one pump section of a composite pump section is in a discharge stroke when the other pump section of the composite pump section is in a suction stroke. The drive control drives the action elements to initiate strokes one at a time at intervals of T/N where T is the time it takes a composite pump section to complete a stroke and N is the number of composite pump sections.

A further object of the present invention is to provide a novel method of operating a reciprocating pump of the type described above, the method comprising driving the action elements so that at any instant at least one of the pump sections is discharging into the common discharge passageway of the pump.

Other objects of the invention and its mode of operation will become apparent upon consideration of the following description and the accompanying drawings.

DETAILED DESCRIPTION OF THE INVENTION

Figure 1:
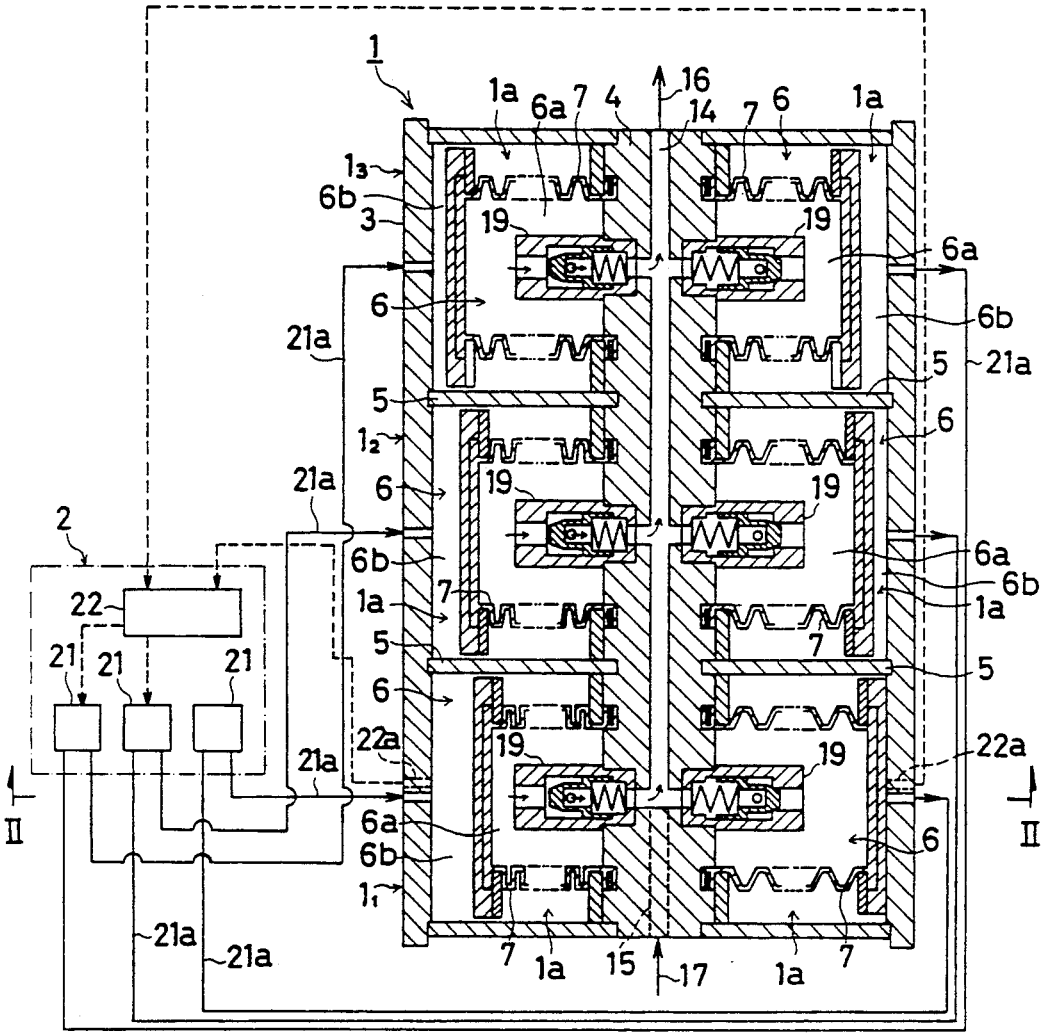
FIG. 1 is a sectional view of a pump taken along the line I—I of FIG. 2, the pump having three composite pump sections.
Figure 2:
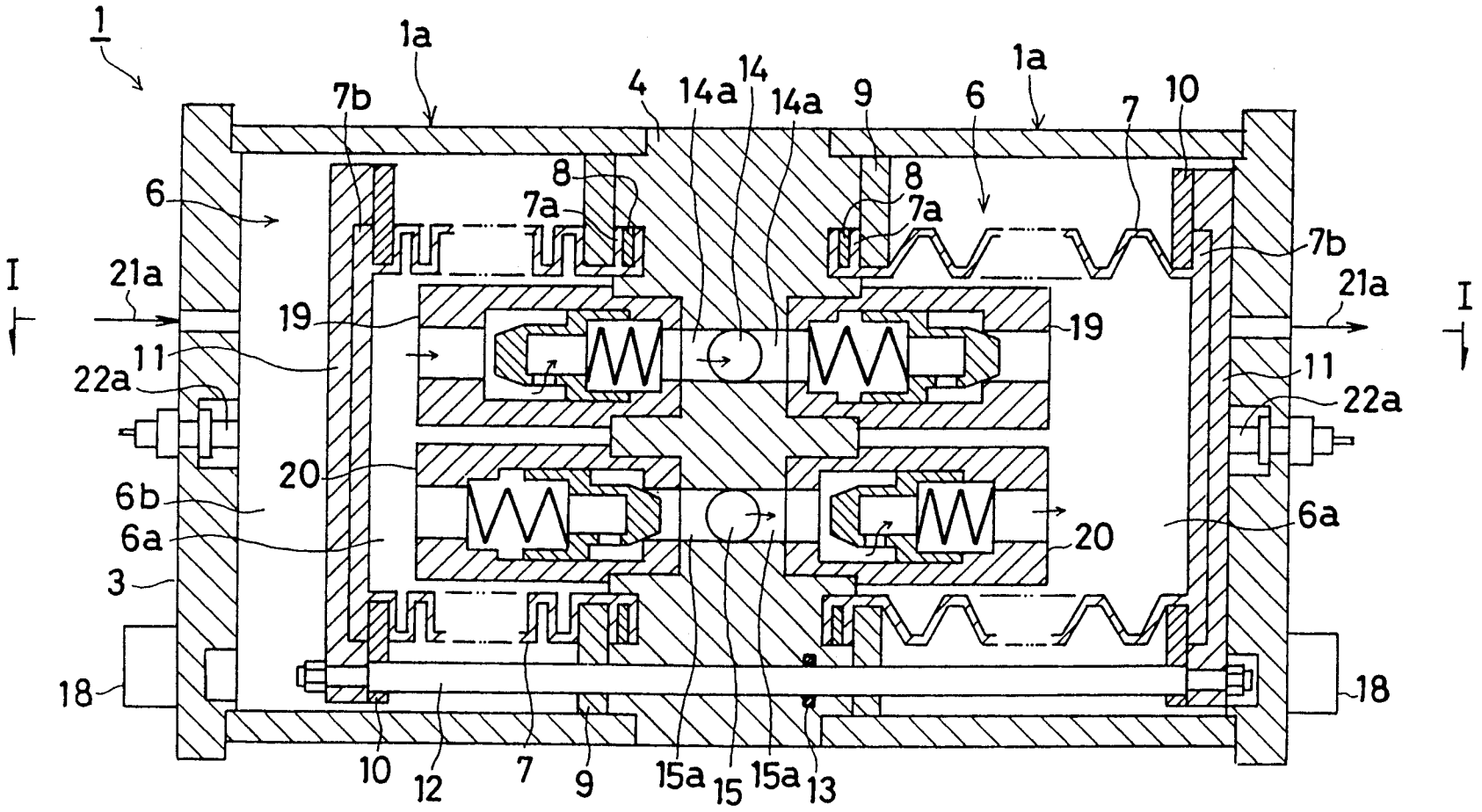
FIG. 2 is a sectional view of a composite pump section taken along the line II—II of FIG. 1.

FIGS. 1 and 2 illustrate a preferred embodiment of the invention wherein a bellows type reciprocating pump 1 is pneumatically actuated by control signals produced by a controller 2.

The pump 1 has a pump casing 3. A head wall 4 extends vertically as viewed in FIG. 1 to divide the interior of the casing into first and second parts. Four cylinder walls 5 extend from the head wall 4 to the casing 3 to further divide the interior of the pump casing into a plurality of pump sections la. The interior of the pump casing 3 is thus divided into three composite pump sections $1_1$, $1_2$ and $1_3$ with each composite pump section having a pair of pump sections 1*a*.

Each pump section has a pump chamber 6 and a bellows 7. As shown in FIG. 2, bellows 7 is provided with a peripheral recess 7*a* for receiving a gasket 8. The head wall 4 is provided with an annular recess for receiving the gasket 8 and the open end of bellows 7, and an annular clamp 9 secures the gasket and bellows to the head wall. The bellows 7 therefore hermetically divides pump chamber 6 into a pump action chamber 6*a* within the bellows and a pump operation chamber 6*b* outside the bellows.

The free end of bellows 7 has a peripheral flange 7*b* which is clamped to an action plate 11 by an annular clamp plate 10. The pair of bellows 7 in each of the composite pump sections $1_1$, $1_2$ and $1_3$ are mechanically interconnected so as to move in synchronism. The connecting means comprises a plurality of rods 12 only one of which is shown in FIG. 2. The rods 12 are threaded at both ends and bolted to the action plates 11 to which the bellows are clamped. Each rod 12 extends through head wall 4 and is free to reciprocate therein. An O-ring 13 surrounds each rod and serves to seal the chamber 6*b* in one pump section 1*a* from the chamber 6*b* of the other pump section. The length of rods 12 is chosen such that when one bellows 7 of a composite pump section is fully extended the other bellows of that composite pump section is in its most contracted state.

The headwall 4 has a plurality of passageways formed therein including a fluid discharge passageway 14 and a suction or fluid supply passageway 15. The fluid supply passageway 15 is connected to a source of fluid to be pumped, this source being indicated at 17 in FIG. 1. The supply passageway has a plurality of branch passageways 15*a*, each of which is connected through a respective check valve 20 to the pump action chamber 6*a* inside a respective bellows 7. The check valves 20 permit the flow of fluid from the supply passageway to the pump action chambers 6*a*. The pump action chamber 6*a* inside each bellows 7 is connected through a check valve 19 and a branch passageway 14*a* to the discharge passageway 14 so that all pumped fluid is discharged from the pump through check valves 19 and passageway 14 to external piping indicated generally at 16 in FIG. 1.

Figure 3:
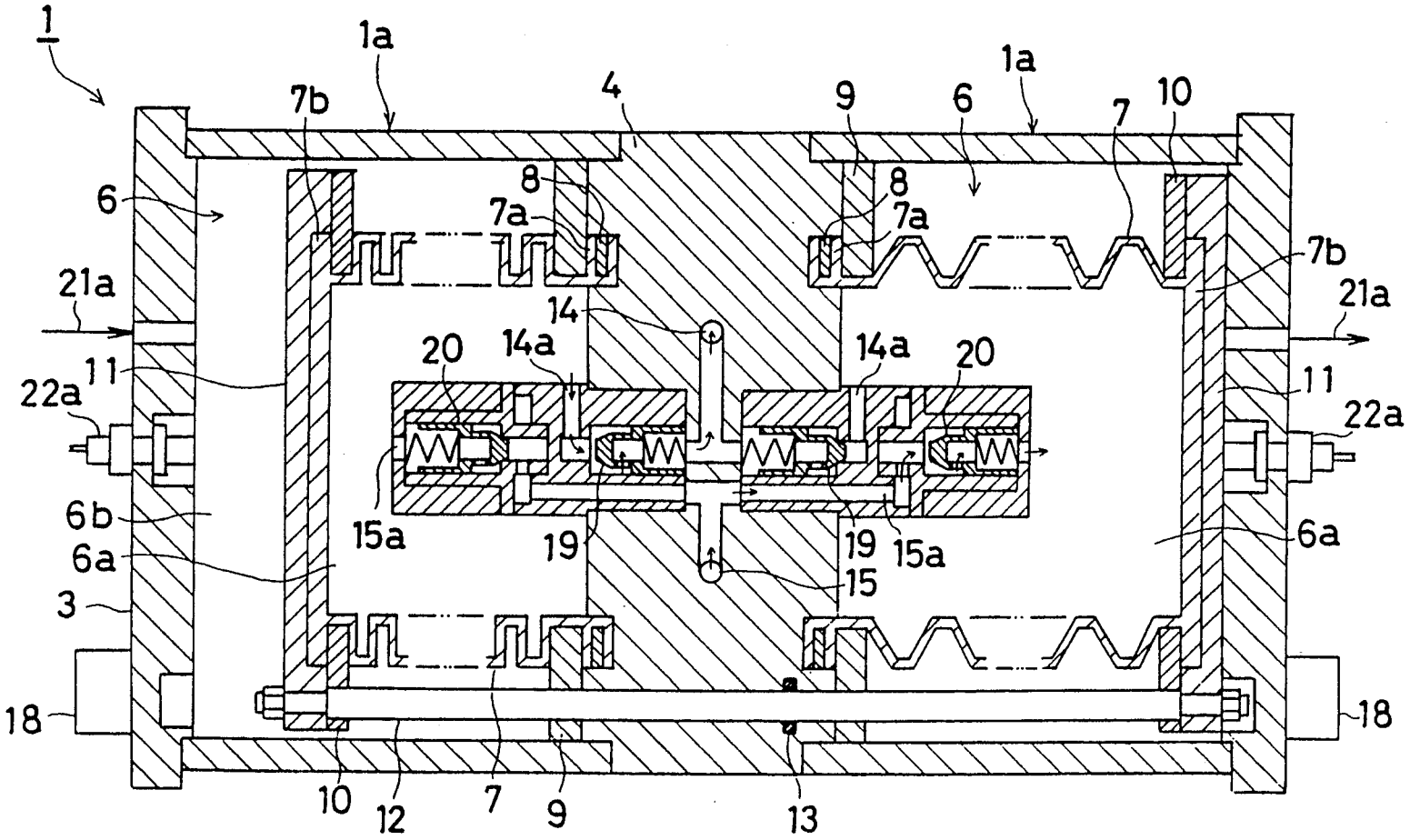
FIG. 3 is a sectional view showing an alternative pump section construction.

The check valves 19 and 20 may be completely separate valves as illustrated in FIG. 2 or the check valves 19 and 20 for a given pump section la may be integrally formed as shown in FIG. 3 so as to have a single monolithic valve body.

Each pump section 1*a* is provided with a fluid leakage detector 18 for detecting the leakage of fluid from the pump action chamber 6*a* to the pump operation chamber 6*b*.

Each composite pump section is driven by alternately applying a fluid pressure to the pump action chamber 6*b* of one of its pump sections 1*a* while connecting the chamber 6*b* of the other pump section to an exhaust, and then reversing the connections. Referring to FIG. 2, the arrows 21*a* represent pipes or fluid conduits and the direction of flow of fluid therein at a particular instant in time. FIG. 2 depicts the position of a composite valve section as it completes a stroke. During this stroke fluid pressure has been applied to the chamber 6*b* on the left side of the FIGURE through one pipe 21*a* while the chamber 6*b* on the right side has been exhausted. The fluid pressure in left chamber 6*b* has compressed the left bellows 7 so as to force fluid from the chamber 6*a* through the left check valve 19 into the discharge passageway 14. At the same time, the right bellow 7 has been expanded thereby creating a suction in the right chamber 6*a* to draw fluid from supply passageway 15 through the right check valve 20 and into the chamber.

After a change-over interval (subsequently discussed) a new stroke is initiated during which fluid pressure is applied to chamber 6*b* of the right pump section while the chamber 6*b* of the left pump section is connected to an exhaust. That is, the fluid flows are opposite to the directions indicated at 21*a*. Therefore, the right bellows 7 is compressed as the left bellows 7 expands. As the right bellows is compressed, fluid in the right chamber 6*a* is forced through right check valve 19 and into the discharge passageway 14. At the same time, expansion of the left bellows 7 draws fluid from the supply passageway 15 through the left check valve 20 into the left chamber 6*a*. At the end of this stroke another change-over interval occurs after which another stroke is initiated to drive the composite pump section back to the position illustrated in FIG. 2.

From the foregoing description it is seen that each pump section la has a suction stroke during which fluid is drawn into the chamber 6*a* from the supply passageway 15 and a discharge stroke during which fluid is discharged from chamber 6*a* into the discharge passageway 14. Between each stroke is a change-over interval.

Figure 7:
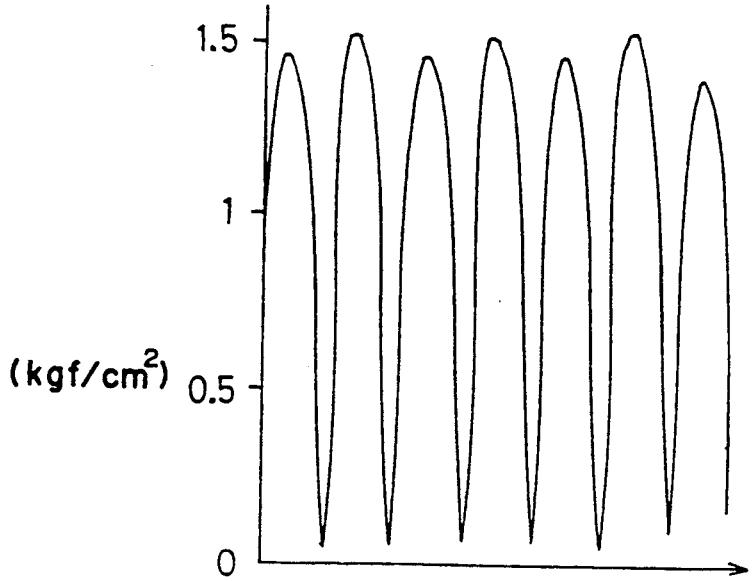

The pump described above was tested under the following conditions. Fresh water at 25° C. was supplied to the pump through passageway 15 and pressurized air at 4kgf/cm$^2$ was selectively applied to the chambers 6*b* of only one composite pump section. This resulted in a stroke rate of 50 strokes per minute with the stroke time T being about 0.6 sec. The discharge pressure in the discharge passageway 14 was monitored and plotted, yielding a curve as shown in FIG. 7. During the change-over intervals between strokes, the discharge pressure drops almost to zero with peaks of pressure occurring at the end of each stroke. In FIG. 7, alternate pressure peaks are produced during the discharge stroke of one pump section 1*a* and the intervening peaks are produced by the discharge stroke of the other pump section. This accounts for the differences in magnitude of adjacent peaks.

Figure 6:
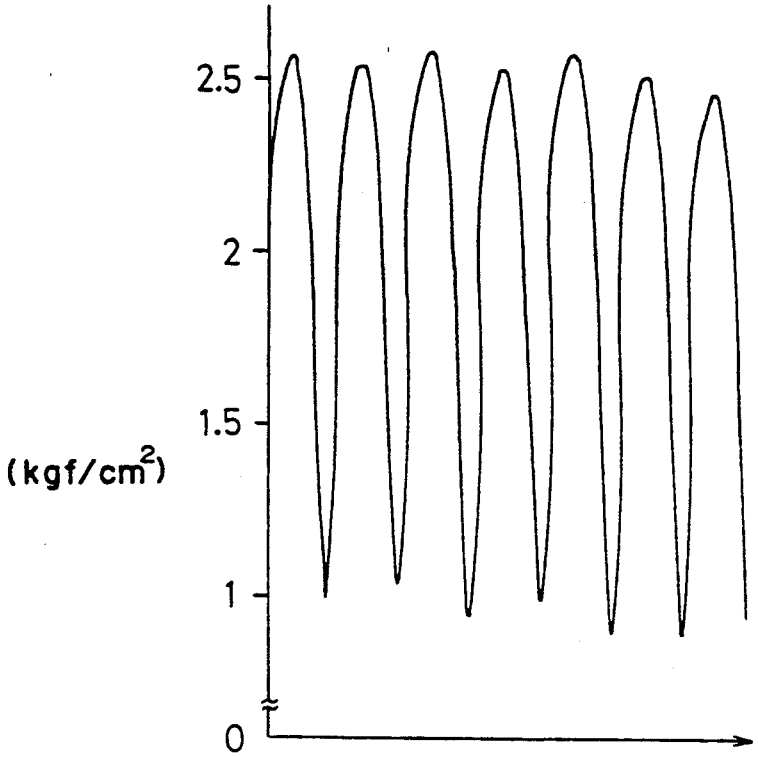
FIG. 6 is a plot of the discharge pressure of the pump shown in FIG. 1 when the action elements are driven in unison; and, FIG. 7 is a plot of the discharge pressure of the pump shown in FIG. 1 when the action element of only one composite pump section is driven.

A second test was conducted under similar conditions except that all three composite pump sections $1_1$, $1_2$ and $1_3$ were driven in unison so that the discharge strokes occurred at the same time. The results are shown in FIG. 6. As compared with FIG. 7, the peak discharge pressures are higher and the minimum pressures occurring during the change-over interval are also higher. However, the difference between the peak pressures and minimum pressures are about the same (1.5 kgf/cm$^2$) for the two cases.

The variations in pressure (i.e. pressure pulses) occurring in the discharge passageway 14 cause various problems in systems downstream of passageway 14 depending on the type of system to which the pump is connected. The pressure pulses can cause pipe vibration with attendant noise, enlarge filter openings, or dislodge accumulated deposits from the interior of pipes.

Figure 5:
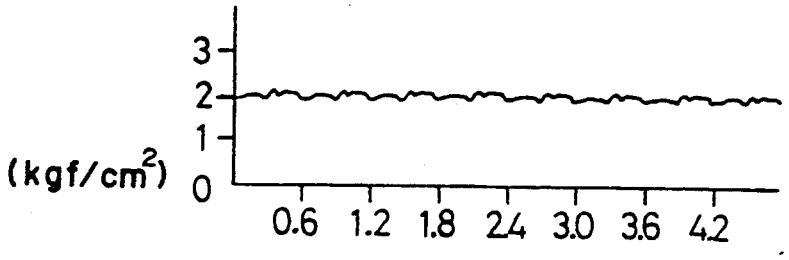
FIG. 5 is a plot of the discharge pressure of the pump shown in FIG. 1 and controlled in accordance with the present invention.

According to the present inventive method, operation of one of the composite pump sections is used as a reference for timing the initiation of the strokes of the other composite pump sections so that at any instant in time at least one composite pump section is in a discharge stroke. Stated differently, the operation is such that when any one of the composite pump sections is in a change-over interval, at least one of the other two composite pump sections is in a discharge stroke. Since at least one composite pump section will be discharging into discharge passageway 14 at any given time, the pressure in the discharge passageway will never drop below the peak values shown in FIG. 7. Furthermore, by equally spacing the times at which the strokes of the composite pump sections $1_1$, $1_2$, $1_3$ are initiated, the pressure in discharge passageway 14 may be maintained at a level greater than the highest peak value in FIG. 7 with relatively small pressure pulses. This is illustrated in FIG. 5.

In order to synchronize the stroke timing of the composite pump sections, one composite pump section is selected as a reference. For purposes of illustration, composite pump section $1_1$ is selected. As shown in FIG. 2, composite pump section $1_1$ is provided with left and right sensors 22*a* mounted in the pump casing 3. One sensor is mounted so as to sense the right action plate 11 and produce an output signal when the right bellows 7 moves away from its fully extended position. The other sensor performs a similar function with respect to the left action plate 11 and left bellows 7.

Assume that the composite pump section $1_1$ is in the position illustrated in FIG. 2 at the time conduit fluid pressure is applied through the right fluid conduit 21*a*. As the right bellows 7 is compressed and the right action plate 11 moves away from the right sensor 22*a*, the sensor produces an output signal indicating the starting of a composite pump section stroke. At the end of the stroke, the left sensor 22*a* senses the presence of the left action plate 11 and produces an output signal indicating the end of the stroke. When pressurized fluid is applied over the left fluid conduit 21*a* to the left chamber 6*b*, the left action plate moves away from left sensor 22*a* and it produces a second signal indicating the start of another stroke of the composite pump section. The end this stroke is signalled by the right sensor 22*a* when the right action plate again reaches the position shown in the drawing. Thus the right sensor 22*a* signals the beginning of a stroke of composite pump section 11 as it moves to the left and the end of the next stroke as the composite pump section moves to the right. Left sensor 22*a* signals the end of a stroke to the left and the beginning of a stroke to the right.

As shown in FIG. 1, the output signals from the right and left sensors are applied to a control synchronizing circuit 2 which includes a delay control 22 and a plurality of pneumatic drives 21, 211. The signals from right and left sensors 22*a* are applied to the delay control 22. The delay control may be a microprocessor or any other conventional means for measuring the time interval T which elapses during one stroke of composite pump section $1_1$, dividing the measured interval by the number N of composite pump sections, and producing output signals at intervals of T/N. Since the embodiment shown has three composite pump sections the delay control produces two output signals, one at time T/3 and another at time 2T/3 after a stroke of composite pump section 1 is initiated. These two signals control the pneumatic drives 21.

The pneumatic drives 21 are of conventional design and each includes a change-over valve and an electrical control circuit for actuating the changeover valve in response to signals from the delay control 22. Each change-over valve is connected to a source of pneumatic pressure, an exhaust port and the fluid conduits 21*a* which are connected to the right and left pump operating chambers 6*b* of a composite pump section controlled by the pneumatic drive. The arrangement is such that a source of air under pressure is connected to the left pump operating chamber 6*b* while the right pump operating chamber is connected to the exhaust port. Upon occurrence of a change-over, initiated by a signal from delay control 22, the connections are reversed so that the left pump operating chamber is connected to the exhaust port and the right pump operating chamber is connected to the source of pressure. Since the pressure drives 21 are of conventional design and may take many forms, the details thereof are not shown in the drawing.

The pneumatic drive $21_1$ has a change-over valve connected as described above. However, because the outputs of pneumatic drive $21_1$ are connected via conduits 21*a* to the composite pump section $1_1$ which serves as the timing reference, its control circuit receives no signal from delay control 22. Instead, the control circuit in pneumatic drive $21_1$ is freerunning and controls its associated change-over valve to change over at the end of each interval T where T represents a time at least equal to the time it takes the composite pump section $1_1$ to make one stroke. Therefore, the change-over valve in pneumatic drive $21_1$ repeatedly cycles so the composite pump section $1_1$ is continuously driven through a stroke to the left followed after a change-over by a stroke to the right.

Figure 4:
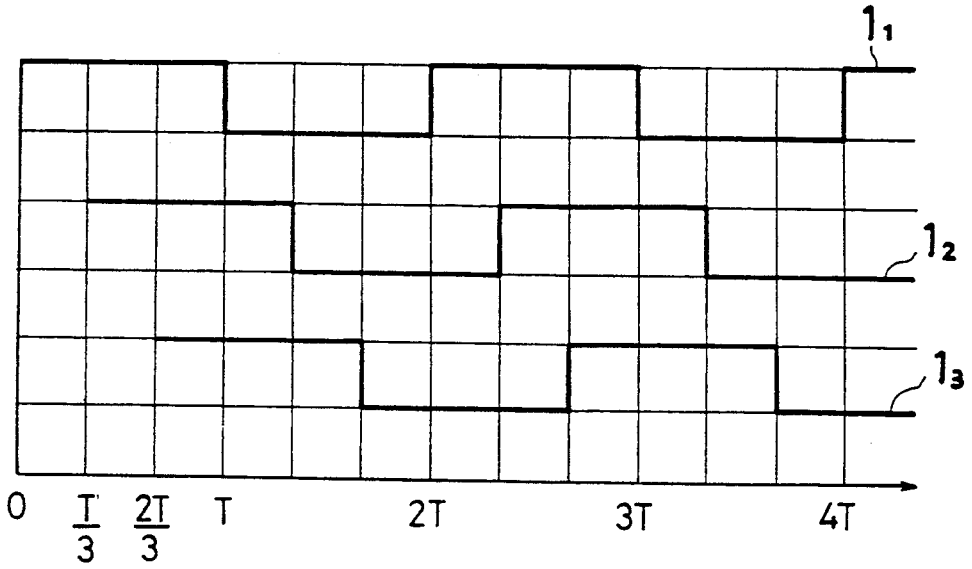
FIG. 4 is a timing diagram illustrating the relative timings of the discharge and suction strokes of three pump sections driven in accordance with the present invention.

FIG. 4 is a wave-form diagram illustrating the action of a single pump section 1*a* in each of the composite pump sections $1_1$, $1_2$ and $1_3$. Since each composite pump section has two pump sections 1*a* which act in a complementary manner, it will be understood that the waveforms for the other pump sections will be the inverse of those shown. For purposes of the following discussion it will be assumed that the waveforms of FIG. 4 represent the discharge/suction of the right pump sections la in the three composite pump sections.

From FIG. 4 it is evident that at times T, 3T, etc., when the right pump section 1*a* of composite pump section $1_1$ is changing over from a discharge to a suction stroke, the right pump sections of composite pump section $1_2$ and $1_3$ are discharging into the discharge passageway 14. At time T=T/3, 2T+T/3, etc, when the right pump section of composite pump section $1_2$ is changing over from a discharge to a suction stroke, the right pump section of composite pump section of composite section $1_3$ and the left pump section of composite pump section $1_1$ are discharging. At times T+2T/3, 2T+2T/3, etc. when the right pump section of composite pump section $1_3$ is changing over from a discharge to a suction stroke, the left pump sections of composite pump sections $1_1$ and $1_2$ are discharging. Thus, during the interval in which a right pump section in any composite pump section is changing over from a discharge to a suction stroke, there is a pump section in each of the other composite pump sections which is discharging into the discharge passageway 14. A similar analysis of FIG. 4 with respect to the change-over times from suction to discharge stokes is believed unnecessary in view of the foregoing description. Such an analysis will show that when either pump section in any composite pump section is making a change-over, one pump section in the other two composite sections will be discharging into the discharge passageway 14.

The pump of FIG. 1 was used to pump fresh water at 25° C. with air at a pressure of 4 kgf/am$^2$ being applied to the pump operating chambers 6*b* through the pressure drives 21, 211. This produced a stroke rate of 50 strokes per minute or approximately T=0.6 sec. The delay time between the starting of individual composite pump sections was thus approximately 0.2 sec. The discharge pressure was measured and plotted, yielding a curve as shown in FIG. 5. The variations in pressure in the discharge were as small as 0.5 kgf/cm$^2$.

Comparing FIG. 5 with FIGS. 6 and 7 it is obvious that the same pump, when provided with a delay control as described above, provides an output with smaller pressure variations than a pump not having the delay control. This is true whether a single composite pump section is driven (FIG. 7) or all three composite pump sections are driven in unison (FIG. 6). Furthermore, the pump equipped with a delay control produces a higher discharge pressure than the pump wherein only one composite pump section is driven, and produces a discharge pressure which is about 80% of the peak discharge pressure which can be obtained when the three composite pump sections are driven in unison.

While a preferred embodiment of the invention has been described in specific detail, it should be understood that the principles of the invention may be implemented with structures other than those described. It is not necessary that the delay control be referenced to the stroke of one of the composite pump sections. The stroke of each composite pump section may be individually controlled to establish the optimum delay time that the conditions of pump operation permit. It is also possible to set a timer in advance to control the delay time. The only requirement is to insure that when any one composite pump section is in the change-over between stokes, at least one other composite pump section is discharging into the discharge passageway. Furthermore, the invention is not limited to use with bellows-type pumps but may be used equally well with diaphragm pumps and reciprocating pumps such as those having a reciprocating cylinder or piston. The pump need not have composite pump sections with complementary acting pump sections. Each pump section may be independently driven. In such a pump having n pump sections, the delay time t may theoretically be set within the range of $1.5T/N<t<T$. However, because of the delay which occurs between generation of a delay control signal (as generated by delay control 22 in the described embodiment) and the actual time that a pump section is caused to move in response to that signal, the delay time may be set within the range $T/N \leqq t<T$. This will insure that when any given pump section is in a suction stroke or a change-over interval at least one other pump section will be in a discharge stroke.

The embodiments of the invention in which an exclusive property or privilege is claimed are defined as follows.

We claim:

1. In a reciprocating pump having a plurality of pump sections, each of said pump sections including a reciprocating action element repeatedly movable in first and second directions to define suction and discharge strokes of the pump section, each stroke being separated from a following stroke by a change-over interval, each said pump section having a discharge outlet connected to a common discharge passageway for the pump and a suction inlet connected to a common supply passageway for the pump, drive control means for driving said action elements so that when at least one of said pump sections is in a suction stroke or a change-over interval at least one other of the pump sections is in a discharge stroke, wherein said drive control means includes means for driving said action elements to initiate said strokes at intervals t where $T/n \leqq t<T$ is the time it takes a pump section to complete a stroke and n is the number of pump sections, the improvement comprising: said drive means comprise pneumatic means for pneumatically moving said reciprocating action element, and further including sensor means disposed at both limits of motion of said action element in said first and second direction of at least one pump section for repeatedly providing start and end signals indicating both the start and end of a stroke and delay means responsive to said start and end signals for producing a plurality of $n-1$ pump actuating signals delayed with respect to one another.

2. Apparatus as claimed in claim 1 wherein said action element comprises bellow means hermetically dividing said pump section into an action chamber within said bellow means and a pump operation chamber outside said bellow means, and further including means for detecting leakage of fluids from said action chamber to said operation chamber.

* * * * *